US007517177B2

(12) United States Patent
Erdemgil

(10) Patent No.: US 7,517,177 B2
(45) **Date of Patent: *Apr. 14, 2009**

(54) METHOD FOR THE REDUCTION OF LIQUEFACTION POTENTIAL OF FOUNDATION SOILS UNDER THE STRUCTURES

(75) Inventor: Mete E. Erdemgil, Ankara (TR)

(73) Assignee: Benefil Worldwide Oy, Tampere (FI)

( * ) Notice: Subject to any disclaimer, the term of this patent is extended or adjusted under 35 U.S.C. 154(b) by 0 days.

This patent is subject to a terminal disclaimer.

(21) Appl. No.: 11/861,321

(22) Filed: Sep. 26, 2007

(65) Prior Publication Data

US 2008/0050182 A1 Feb. 28, 2008

Related U.S. Application Data

(63) Continuation-in-part of application No. 10/534,696, filed as application No. PCT/TR03/00083 on Nov. 5, 2003, now Pat. No. 7,290,962.

(30) Foreign Application Priority Data

Nov. 13, 2002 (TR) ..... A 2002 02517

(51) Int. Cl.
*E02D 27/26* (2006.01)

(52) U.S. Cl. ..... 405/302.4; 405/266; 405/271; 405/229

(58) Field of Classification Search ..... 405/229, 405/263, 266, 267, 269–271, 302.4, 302.6
See application file for complete search history.

(56) References Cited

U.S. PATENT DOCUMENTS

| | | | | |
|---|---|---|---|---|
| 2,627,169 | A | 2/1953 | Poulter | |
| 4,832,533 | A | 5/1989 | Ringesten | |
| 5,181,797 | A | 1/1993 | Circeo et al. | |
| 5,868,525 | A | 2/1999 | Takahashi | |
| 6,634,831 | B2 | 10/2003 | Canteri | |
| 6,659,691 | B1 | 12/2003 | Berry | |
| 7,011,475 | B2 | 3/2006 | Shiraishi | |
| 7,290,962 | B2 * | 11/2007 | Erdemgil | 405/302.4 |

FOREIGN PATENT DOCUMENTS

| | | |
|---|---|---|
| EP | 0 773 328 | 5/1997 |
| EP | 0 851 064 | 7/1998 |
| EP | 0 851 064 A1 | 7/1998 |
| JP | 6-108449 | 4/1994 |
| JP | 9-195257 | 7/1997 |
| JP | 2001-510514 | 7/2001 |
| JP | 2005-146776 | 6/2005 |

* cited by examiner

*Primary Examiner*—Frederick L Lagman
(74) *Attorney, Agent, or Firm*—Young & Thompson

(57) ABSTRACT

The aim of this invention is to present a method in which holes (1) are drilled into the ground for the injection of highly expansive grouts (5), so that the subsoil is void filled and compacted and thus the liquefaction potential under earthquake and vibration forces are reduced.

3 Claims, 7 Drawing Sheets

METHOD FOR THE REDUCTION OF LIQUEFACTION POTENTIAL OF FOUNDATION SOILS UNDER THE STRUCTURES

CROSS-REFERENCE TO RELATED APPLICATIONS

This is a continuation-in-part of application Ser. No. 10/534,696 filed on May 13, 2005, as the 35 U.S.C. 371 National Stage of International Application PCT/TR03/00083 filed on Nov. 5, 2003, which designated the United States of America, now U.S. Pat. No. 7,290,962.

TECHNICAL FIELD

This invention relates to a method of reduction of liquefaction potential of foundation soils under the buildings.

STATE OF ART

Engineering structures (buildings) need a safe foundation soil, capable of carrying the loads, transferred from the superstructure. But some soils loose their bearing capacity and liquefy under earthquake loads. At the end, the buildings resting on liquefied soils are damaged and may be out of service.

Loss of shear strength of foundation soils under earthquake loads and vibrations are first referred by Japanese scientists Mogami and Kubo (1953) as Liquefaction. Following the earthquakes of Alaska and Niigata in Japan an intensive research has been carried out in the last 30 years and the term "Liquefaction" is used as a generally accepted terminology in the international earthquake literature.

When the ground acceleration reaches the foundation, an earthquake liquefaction takes place. This liquefaction causes damage to the buildings, instability of the slopes, failure of bridge or building foundations or swimming of buried engineering structures with an upward movement.

Liquefaction as defined by Mogami and Kubo is a complex process occurring in saturated cohesionless soils under untrained conditions, when subjected to monotonical transient or cyclic loads.

Increase of excess pore pressure under undrained conditions is the major factor in liquefaction.

Under statical or cyclic loading conditions dry cohesionless soils may also be subjected to settlement. Saturated, cohesionless soils decrease their volumes due to their tendency to settlement. Rapid loading and untrained conditions, cause an increase in pore pressure, resulting liquefaction.

There are two main precautions against foundation soils with high liquefaction potential. The first one is to evade any building construction on such soils. The second one is to improve the foundation soils with liquefaction potential.

The classical and common way is to order piles under the structure. In this way the foundation loads are transmitted to deeper soil layers with no liquefaction potential. Beyond the requirement that such a precaution needs heavy equipment to be used and thus costly, it also has some technical limitations. If the liquefiable soils go down to very deep elevations, the application may not be economical and/or practical. Also the behaviour of pile-structure interaction in liquefied soils is not clearly known at the present state of the art.

The most important factor in the liquefaction of soils is the loose structure of the soil. The change of soil configuration of the soil grains from loose to dense state, decreases the liquefaction potential very considerably.

With this idea, "Dynamic Compaction Method" is used, in which heavy loads are dropped on loose soils, to improve their load bearing capacities, and decrease the liquefaction potential, using very heavy cranes, which have high costs, making the compaction expensive.

Beyond that, all the previously mentioned improvement techniques require heavy machinery and they are expensive, they require large areas for their field application. Existence of buildings on the site, is another severe limitation to the use of such machinery.

THE SCOPE AND APPLICATION OF THE INVENTION

The objective of the present invention is to reduce the liquefaction potential of foundation soils under the buildings, securing their performance under static and dynamic loads, In this context to present a method to decrease the liquefaction potential without introducing cementitious materials into the foundation soil is aimed.

Another aim is to present a method which can be applied under new buildings as well as already existing structures, without disturbing the available facilities.

Considering this aim and other factors mentioned here, the aim of this invention is to present a method which reduces the liquefaction potential of soils by improving its characteristics.

BRIEF DESCRIPTION OF THE DRAWINGS

Additionally figures are presented to define the applications and the definitive characteristics of the invention. The figures presented lead to a better understanding of the invention, but they do not limit their field of application in anyway. The invented method may be used in many different ways.

APPLICATION OF THE INVENTION METHOD

In the subject method of invention, a number of holes are prepared in the soil to be injected, vertically or at various angles with the vertical. Depth of holes (1) may be different or same and also the horizontal distance between the holes may be different according to the project or soil type to be injected. Similarly as in the case of holes, the pipes (2), may be at various angles or distance from each other.

Afterwards resins with expansion capabilities of many times of its original volume is injected into the soil. They first fill the voids in the soil and then begin to expand, compacting the existing soil so that liquefaction potential is reduced to very low limits or even zero. The injection of the resin into the natural soil (4), follows the path of minimum resistance, thus filling the voids in the soil.

Figure 1:
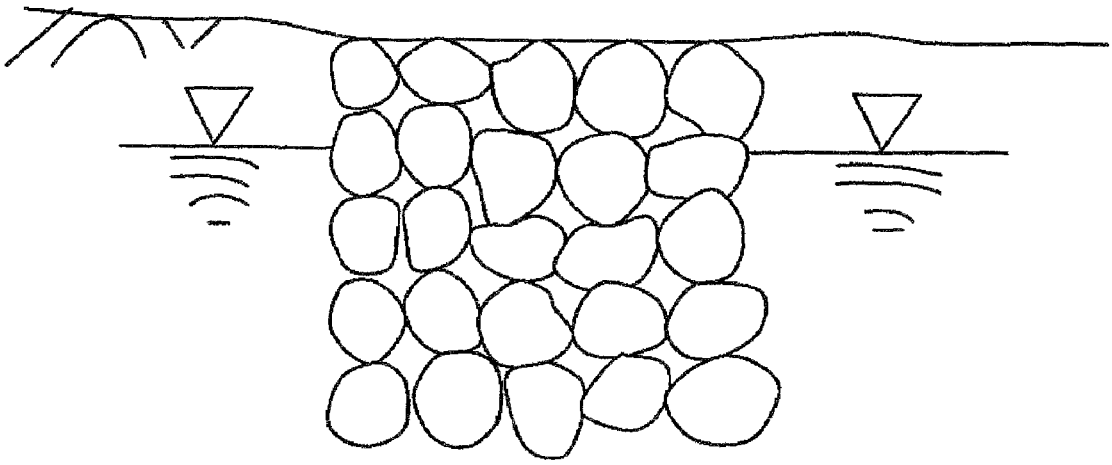
FIG. 1, gives a general view of the soil type. According to the generally accepted principals of international soil mechanics literature, soil has three components, namely solid particles, water and air. This figure is given for granular soils, but the method of the invention can be used in any type of soil without limitation.
Figure 2:
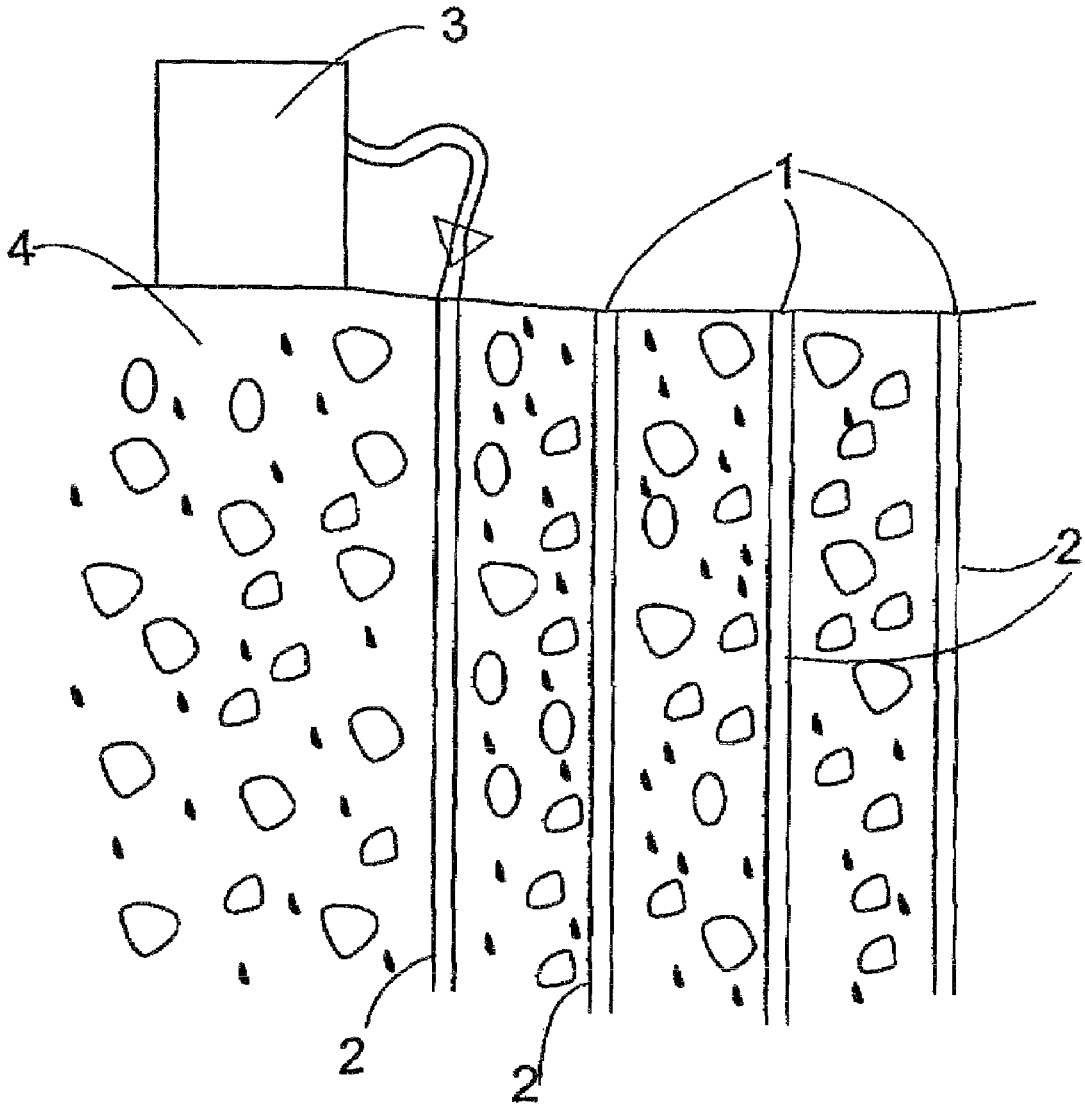
FIG. 2, the expansive resin is injected through the drilled holes into the soil. The injection material is pumped from a storage tank at the surface.
Figure 3:
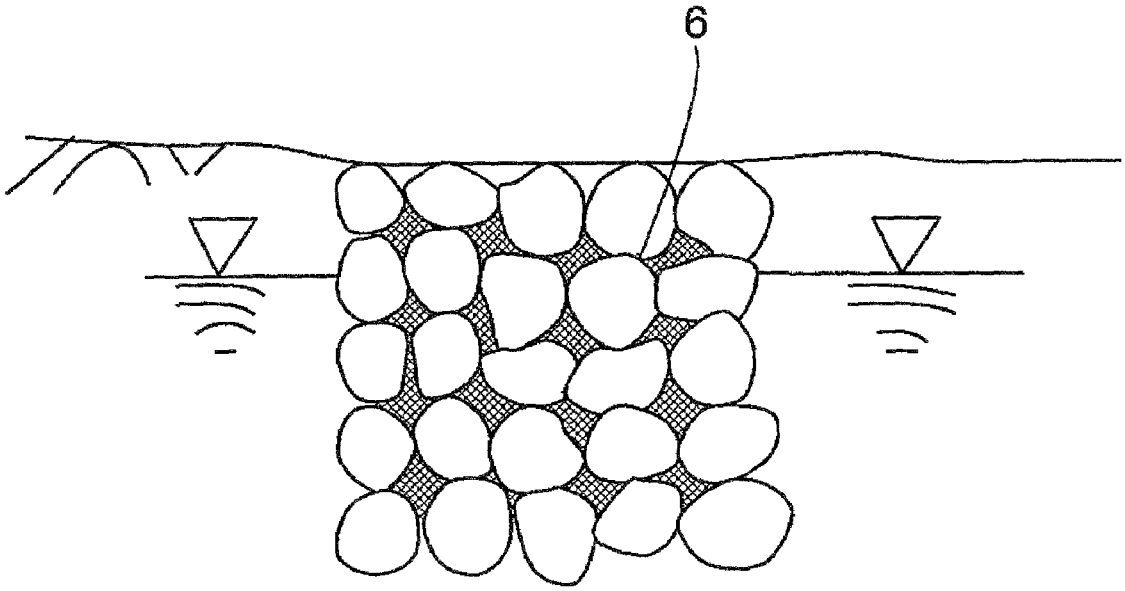
FIG. 3, shows the replacement of air and water in the soil pores, by expansive resin.
Figure 4:
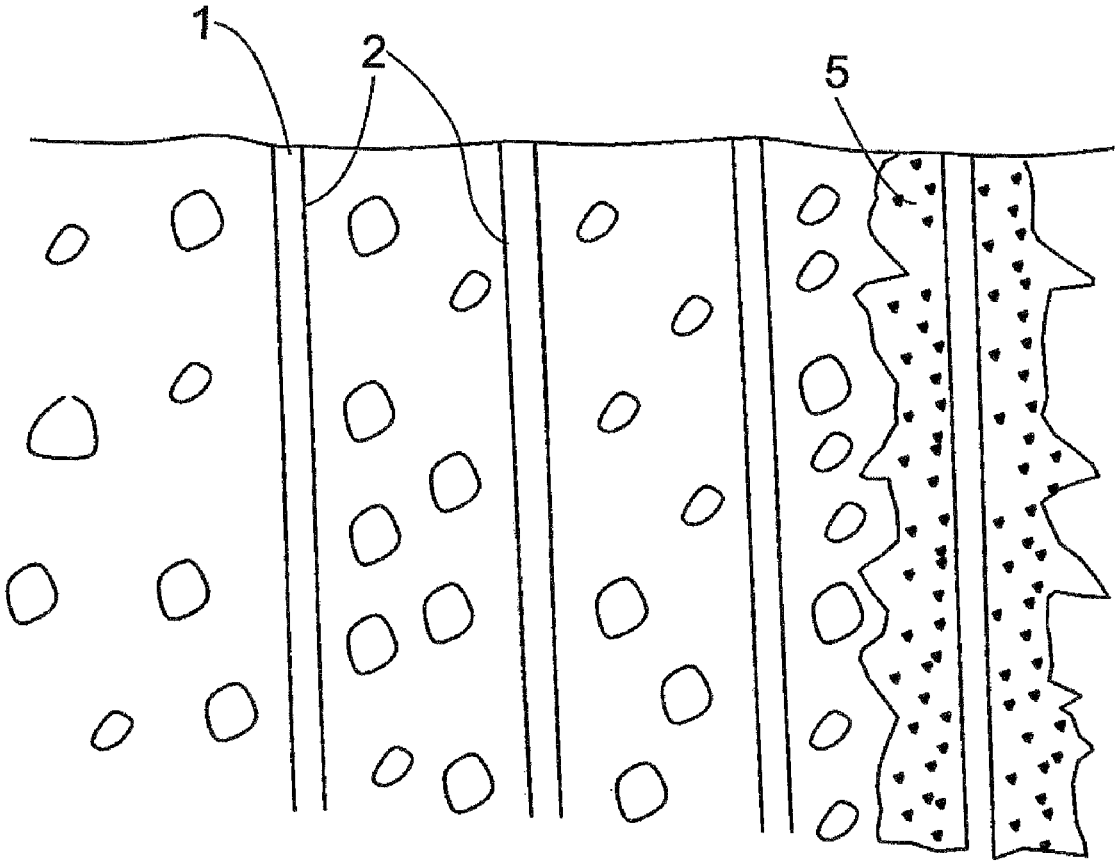
FIG. 4, and FIG. 5 show the approach of expansive resin in the soil. The injection of the resin may be given, forming columns of injection as it in FIG. 4, or single bulbs of resin may be formed in the soil as it is in FIG. 5.
Figure 5:
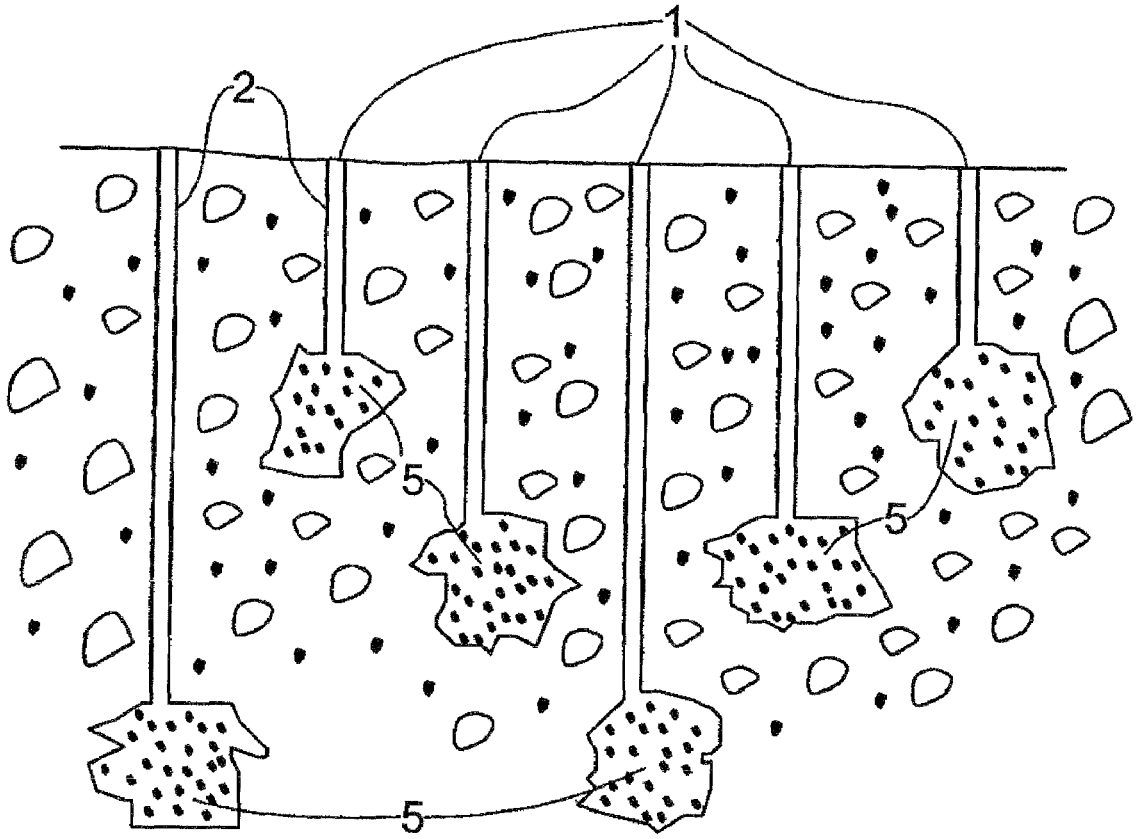

The injection of the resin, which may expand many times of its original volume may be formed in columns as seen in FIG. 4 or in bulbs at different levels as seen in FIG. 5. A planning may be performed considering the soil conditions of the site and the project, which give size and place of the resin bulbs or columns to be formed.

The distance between injection holes should be planned according to the type of foundation soil to be stabilized against liquefaction. If the soil is dense, the distance between the holes may be greater, since the soil has greater shear strength. If the soil is loose, then the distance between the holes should be shorter, since weak soils cannot transfer stresses to longer distances. An average distance may be about 1 m, since the effect of densification may be assumed as a sphere or lateral circle having diameter of 2 m.

The improvement of the foundation soil in this invention method is not limited with the grouting pressure, as it is the case with cementituous materials, but the chemical expansion pressure is the major factor for the neighbouring soil media also. The subsoil is first compacted under pressure and then with the effect of penetrating resin liquefaction potential is almost eliminated.

Fine grained cohesive soils which possess very low permabilities are compacted under the expansion pressure of the resins and their bearing capacity is considerably increased, reducing the liquefaction potential.

The application of the invention method at soil layers close to the surface, the compaction effect may not properly occur due to the lack of overburden pressure. This may be case of application for new constructions. Use of an extra soil fill as it is in FIG. 6 satisfies the required overburden. The necessary compaction counter pressure is supplied with the load of the fill. Later on, extra fill may be removed.

Figure 6:
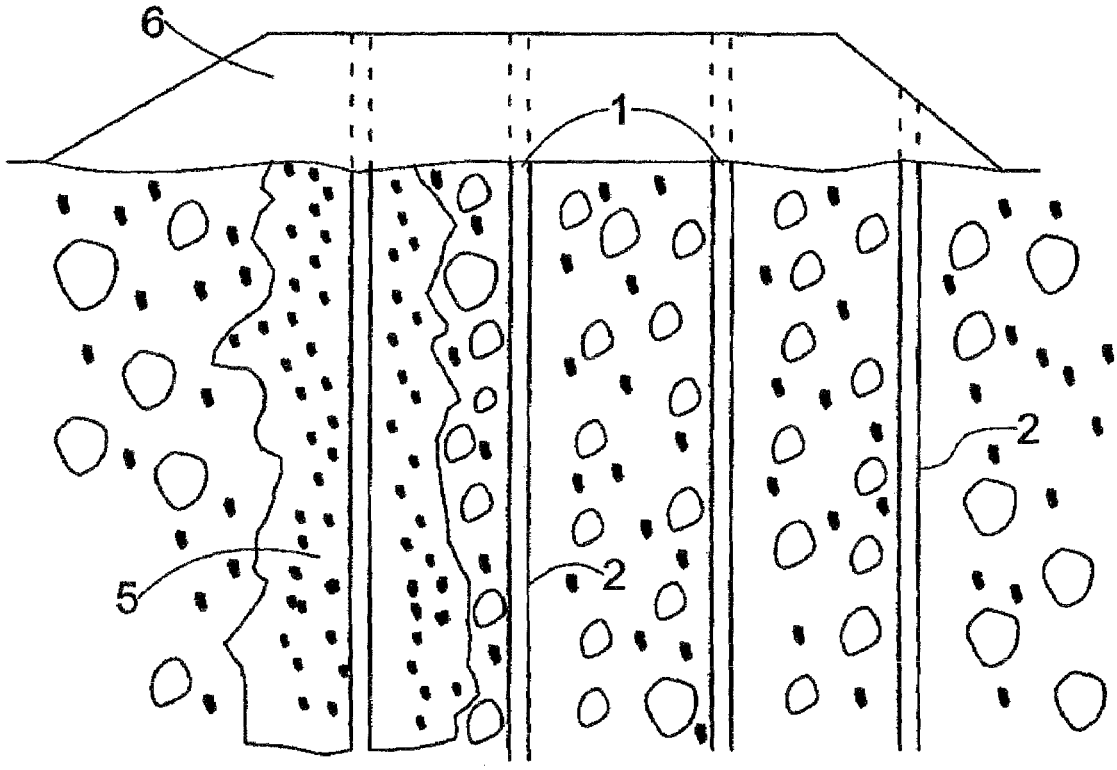
FIG. 6, shows the surcharge fill, which is necessary if the injection has to be performed in the field before the building is erected. The fill supplies the overburden pressure for the compaction of injected soil. It may be removed later.
Figure 7:
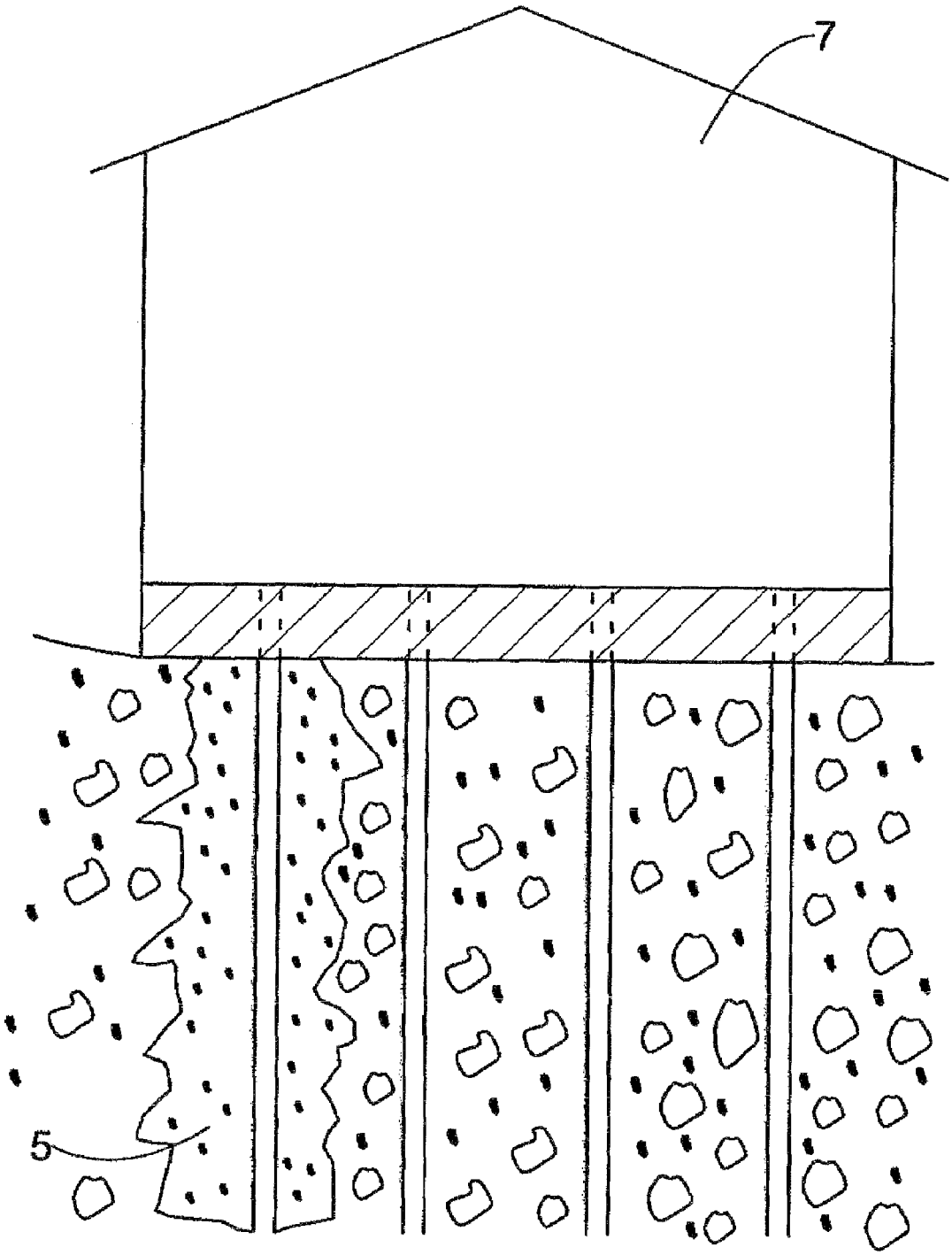
FIG. 7, the use of the building weight is shown, as an overburden for the compaction of subsoil.

If the liquefaction improvement is going to be performed under an existing building, as shown in FIG. 7, such a fill as in FIG. 6 is not required. The weight of the building supplies the necessary pressure balance.

For the injection of expansive resins drilling of various small diameter holes is sufficient. Thus the injection holes do not effect the statical system or the functional use of the building, and cause no reduction in the rigidity of the structure or its service.

Since an expansive pressure of 40-50 tons/m2 is applied after the chemical reaction of the resin, the liquefaction improvement of any type of soil is possible with this system.

The effect of expansion pressure on the building foundations may be detected at the building by means of precise geodetic measurements made externally. With this purpose, measuring equipments making use of laser beams or gages which can measure small fractions of a millimeter may be used. For the liquefaction improvement of the foundation soil before the new construction, the improvement may be secured by displacement measurements made with laser beams at the close vicinity of the injection point.

The counter pressure at deeper layers is not limited with the geostatic overburden pressure at that level. The frictional forces between the soil blocks play also an important role as an extra overburden load. Thus the necessary load for the compaction may be satisfied.

Use of expansive resin is not limited with single layer soils, but it can also be applied in multi-layer soil formations. The application may be performed in single columns or at certain points as shown in FIGS. 5 and 6, and this gives a flexibility to the invention method.

When determining the liquefaction potential, it must be taken into account that the liquefaction potential is high only if the soil type is such that it is highly permeable to water, the ground water level is high and the soil is in an earthquake area.

For example granular soils, such as sand and gravel, are highly permeable to water. Cohesive soils, such as clay, have a very low permeability.

The ground water level is simply observed by drilling a hole into the ground and observing the water level. If the ground water table is close to the surface, for example if the ground water table is less than 5 meters from the surface, it is high. If the ground water table in the hole is for example deeper than 10 meters from the surface it is low.

Above the ground water table (GWT) no liquefaction is expected. If the geo-static pressure is high, e.g. at a depth of greater than 8-10 m, liquefaction does not occur either. So the requirement for liquefaction prevention is typically necessary at depths less than 8-10 m and below the ground water table (GWT).

An earthquake area is determined by statistical data. An earthquake area is an area where earthquakes occur often. The earthquake areas are determined by observing the frequency of earthquakes in a region and their magnitudes in the historical data.

The properties of the soil can be measured for example with a penetrometer or with any other suitable measuring means. The properties of the soil can be also measured after the expansive resin is injected. Thus it is not necessary to observe a reaction above the ground level. Thus there is no reason to raise the building but the properties of the soil can be measured through the soil.

The liquefaction potential of a soil can also be determined, among other parameters, from the Standard Penetration Test (SPT) results. If the soil has a high SPT resistance, it has a lower liquefaction potential. Applying Standard Penetration Tests before and after injection gives a very clear value on the liquefaction potential reduction of the soil.

Also, for determining the liquefaction potential of the soil, SPT and/or Pressure Meter tests and Sieve Analysis on the soil samples from the corresponding depths may be used.

The expansive resin can be injected through a pipe comprising holes in its walls, whereby the resin can also penetrate into the soil through the walls of the pipe. After the injecting, the pipe can be left in the ground.

The quantity of the resin injected into the ground can also be determined such that the resin is injected for such a long time that it easily goes to the ground. Thus, when the counter pressure of the injected resin rises, the quantity of the resin injected into the ground is sufficient.

The invention claimed is:

1. A method for the reduction of liquefaction potential of foundation soils, comprising determining the liquefaction potential of a foundation soil under an existing building, and on the basis of the determination, drilling holes through the structure of the building at a distance from each other, and injecting expansive resins filling the voids and compacting it, the building providing compaction counter pressure, thus obtaining a strong and compact foundation soil under the building with reduced liquefaction potential.

2. The method of claim 1, wherein the liquefaction potential is measured by laser equipment or other sensitive measurement gauges.

3. The method of claim 1, wherein the liquefaction potential is measured after injecting the resin.

* * * * *